US010011460B2

(12) United States Patent
Collins et al.

(10) Patent No.: US 10,011,460 B2
(45) Date of Patent: Jul. 3, 2018

(54) ELEVATOR DYNAMIC DISPLAYS FOR MESSAGING AND COMMUNICATION

(71) Applicant: Otis Elevator Company, Farmington, CT (US)

(72) Inventors: James M. Collins, Burlington, CT (US); Ronnie E. Thebeau, Haddam, CT (US); Paul A. Stranieri, Bristol, CT (US); Jannah A. Stanley, Portland, CT (US); David M. Hughes, East Hampton, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 0 days.

(21) Appl. No.: 15/277,214

(22) Filed: Sep. 27, 2016

(65) Prior Publication Data

US 2018/0086596 A1 Mar. 29, 2018

(51) Int. Cl.

| | |
|---|---|
| ***B66B 3/00*** | (2006.01) |
| ***B66B 9/00*** | (2006.01) |
| ***B66B 1/28*** | (2006.01) |
| ***B66B 5/02*** | (2006.01) |

(52) U.S. Cl.

CPC ..... *B66B 3/002* (2013.01); *B66B 1/28* (2013.01); *B66B 5/021* (2013.01); *B66B 9/00* (2013.01)

(58) Field of Classification Search

CPC .. B66B 3/002; B66B 1/28; B66B 5/21; B66B 9/00

USPC ..... 187/391

See application file for complete search history.

(56) References Cited

U.S. PATENT DOCUMENTS

| | | | | | |
|---|---|---|---|---|---|
| 4,630,026 | A * | 12/1986 | Lewis | B66B 3/023 | 187/399 |
| 5,197,570 | A * | 3/1993 | Matsui | B66B 9/003 | 187/249 |
| 5,253,734 | A * | 10/1993 | Laurutis | A62B 1/02 | 187/239 |
| 5,955,710 | A * | 9/1999 | DiFranza | B66B 1/34 | 187/247 |
| 5,979,607 | A * | 11/1999 | Allen | B66B 5/024 | 187/384 |

(Continued)

FOREIGN PATENT DOCUMENTS

| | | |
|---|---|---|
| CN | 203474143 U | 3/2014 |
| CN | 103943049 A | 7/2014 |

(Continued)

OTHER PUBLICATIONS

Extended European Search Report of Application No. 17193290.8-1017; Report dated Feb. 23, 2018; Report Received Date: Mar. 1, 2018; 1-7 pages.

*Primary Examiner* — David Warren

(74) *Attorney, Agent, or Firm* — Cantor Colburn LLP

(57) ABSTRACT

A building elevator system is provided having: an elevator system having an elevator car; a control system configured to control the building elevator system and determine evacuation information; and a dynamic display configured to display the evacuation information when an evacuation call is received by the control system. The evacuation information includes at least one of an estimated time of arrival of the elevated car, an evacuee recommendation, a directional map, and directional instructions.

15 Claims, 4 Drawing Sheets

(56) References Cited

U.S. PATENT DOCUMENTS 6,508,334 B1 * 1/2003 Matsuda ..... B66B 1/462 187/391
6,646,545 B2 11/2003 Bligh
6,998,960 B2 2/2006 Buschmann et al.
7,026,947 B2 4/2006 Faltesek et al.
7,579,945 B1 * 8/2009 Richter ..... G08B 25/14 340/286.14
7,588,126 B2 9/2009 Siikonen et al.
7,621,378 B2 * 11/2009 Kawai ..... B66B 5/021 187/313
7,677,363 B2 * 3/2010 Kawai ..... B66B 5/021 187/313
7,926,621 B2 4/2011 Kawai et al.
8,109,368 B2 2/2012 Manabe
8,251,185 B2 8/2012 Manabe
8,346,474 B2 1/2013 Chen et al.
8,493,230 B2 7/2013 Hikita et al.
8,719,037 B2 * 5/2014 Gazdzinski ..... G06Q 30/0251 187/396
8,738,276 B1 * 5/2014 Boss ..... B61L 27/04 455/404.1
8,810,415 B2 * 8/2014 Grundler ..... A62B 3/00 340/330
8,839,914 B2 * 9/2014 Iwata ..... B66B 5/021 187/384
2002/0129995 A1 * 9/2002 Friedli ..... B66B 3/00 187/392
2003/0057029 A1 * 3/2003 Fujino ..... B66B 3/00 187/391
2004/0124993 A1 7/2004 George
2006/0201751 A1 * 9/2006 Kawai ..... B66B 5/024 187/313
2008/0196978 A1 * 8/2008 Siikonen ..... B66B 5/022 187/384
2009/0057069 A1 3/2009 Boggess
2011/0120812 A1 5/2011 Manabe
2015/0048953 A1 * 2/2015 Murphy, Jr. ..... G08B 25/14 340/691.6
2015/0114763 A1 * 4/2015 Kim ..... B66B 5/0012 187/392
2016/0018226 A1 1/2016 Plocher et al.
2016/0123741 A1 5/2016 Mountain
2017/0036887 A1 * 2/2017 Roberts ..... B66B 1/30
2017/0045493 A1 * 2/2017 van der Woude .... B66B 7/1215
2017/0073187 A1 * 3/2017 Youker ..... B66B 3/008
2017/0073193 A1 * 3/2017 Kuczek ..... B66B 11/0407
2017/0107080 A1 * 4/2017 Steinhauer ..... B66B 9/003
2017/0109132 A1 * 4/2017 Gazdzinski ..... G06F 3/167
2017/0240380 A1 * 8/2017 Reuter ..... B66B 5/027
2017/0261959 A1 * 9/2017 Kuusinen ..... G05B 19/0428

FOREIGN PATENT DOCUMENTS

CN 104978913 A 10/2015
EP 1988048 A1 11/2008
EP 2253570 A1 11/2010
EP 2343262 A1 7/2011
JP 2007131362 A 5/2007
JP 2013035633 A 2/2013
JP 2013103774 A 5/2013
JP 5683019 A 3/2015
WO 9817350 A1 4/1998
WO 2007042605 A1 4/2007
WO 2012026015 A1 3/2012
WO 2012026016 A1 3/2012
WO 2013066259 A1 5/2013
WO 2014191610 A1 12/2014

* cited by examiner

ELEVATOR DYNAMIC DISPLAYS FOR MESSAGING AND COMMUNICATION

BACKGROUND

The subject matter disclosed herein relates generally to the field of elevator systems, and specifically to a method and apparatus for operating an elevator system in an evacuation.

Commonly, during an evacuation procedure occupants of a building are instructed to take the stairs and avoid the elevator systems. An efficient method of incorporating the elevators into overall evacuation procedures is desired.

BRIEF SUMMARY

According to one embodiment, a building elevator system is provided. The building elevator system having: an elevator system having an elevator car; a control system configured to control the building elevator system and determine evacuation information; and a dynamic display configured to display the evacuation information when an evacuation call is received by the control system. The evacuation information includes at least one of an estimated time of arrival of the elevated car, an evacuee recommendation, a directional map, and directional instructions.

In addition to one or more of the features described above, or as an alternative, further embodiments of the building elevator system may include that the estimated time of arrival of the elevator car is determined in response to at least one of a quantity of evacuation calls, an order of each evacuation call, a current location of the elevator car, a speed of the elevator car, a location of the dynamic display, a number of passengers on each floor, and a location of a fire.

In addition to one or more of the features described above, or as an alternative, further embodiments of the building elevator system may include that the evacuee recommendation is determined in response to at least one of the estimated time of arrival, evacuation scenario times, and a location of the dynamic display.

In addition to one or more of the features described above, or as an alternative, further embodiments of the building elevator system may include that the directional map is determined in response to the evacuee recommendation and stored building maps.

In addition to one or more of the features described above, or as an alternative, further embodiments of the building elevator system may include that the directional instructions are determined in response to the directional map.

In addition to one or more of the features described above, or as an alternative, further embodiments of the building elevator system may include that the dynamic display is at least one of a mobile device and a monitor screen that is located on each floor of the building proximate the elevator system.

According to another embodiment, a method of operating a building elevator system is provided. The method having the steps: controlling an elevator system, the elevator system including an elevator car; receiving an evacuation call; determining evacuation information; and displaying, using a dynamic display, evacuation information. The evacuation information includes at least one of an estimated time of arrival of the elevated car, an evacuee recommendation, a directional map, and directional instructions.

In addition to one or more of the features described above, or as an alternative, further embodiments of the method may include that the estimated time of arrival of the elevator car is determined in response to at least one of a quantity of evacuation calls, an order of each evacuation call, a current location of the elevator car, a speed of the elevator car, a location of the dynamic display, a number of passengers on each floor, and a location of a fire.

In addition to one or more of the features described above, or as an alternative, further embodiments of the method may include that the evacuee recommendation is determined in response to at least one of the estimated time of arrival, evacuation scenario times, and a location of the dynamic display.

In addition to one or more of the features described above, or as an alternative, further embodiments of the method may include that the directional map is determined in response to the evacuee recommendation and stored building maps.

In addition to one or more of the features described above, or as an alternative, further embodiments of the method may include that the directional instructions are determined in response to the directional map.

In addition to one or more of the features described above, or as an alternative, further embodiments of the method may include that the dynamic display is at least one of a mobile device and a monitor screen that is located on each floor of the building proximate the elevator system.

According to another embodiment, a computer program product tangibly embodied on a computer readable medium, the computer program product including instructions that, when executed by a processor, cause the processor to perform operations. The operations having the steps of: controlling an elevator system, the elevator system including an elevator car; receiving an evacuation call; determining evacuation information; and displaying, using a dynamic display, evacuation information. The evacuation information includes at least one of an estimated time of arrival of the elevated car, an evacuee recommendation, a directional map, and directional instructions.

In addition to one or more of the features described above, or as an alternative, further embodiments of the computer program may include that the estimated time of arrival of the elevator car is determined in response to at least one of a quantity of evacuation calls, an order of each evacuation call, a current location of the elevator car, a speed of the elevator car, a location of the dynamic display, a number of passengers on each floor, and a location of a fire.

In addition to one or more of the features described above, or as an alternative, further embodiments of the computer program may include that the evacuee recommendation is determined in response to at least one of the estimated time of arrival, evacuation scenario times, and a location of the dynamic display.

In addition to one or more of the features described above, or as an alternative, further embodiments of the computer program may include that the directional map is determined in response to the evacuee recommendation and stored building maps.

In addition to one or more of the features described above, or as an alternative, further embodiments of the computer program may include that the directional instructions are determined in response to the directional map.

In addition to one or more of the features described above, or as an alternative, further embodiments of the computer program may include that the dynamic display is at least one of a mobile device and a monitor screen that is located on each floor of the building proximate the elevator system.

Technical effects of embodiments of the present disclosure include an elevator system having a dynamic display to display evacuation information including the estimated arrival time of the next elevator car and potential alternative evacuation plans.

The foregoing features and elements may be combined in various combinations without exclusivity, unless expressly indicated otherwise. These features and elements as well as the operation thereof will become more apparent in light of the following description and the accompanying drawings. It should be understood, however, that the following description and drawings are intended to be illustrative and explanatory in nature and non-limiting.

BRIEF DESCRIPTION OF THE DRAWINGS

The foregoing and other features, and advantages of the disclosure are apparent from the following detailed description taken in conjunction with the accompanying drawings in which like elements are numbered alike in the several FIGURES.

DETAILED DESCRIPTION

Figure 1:
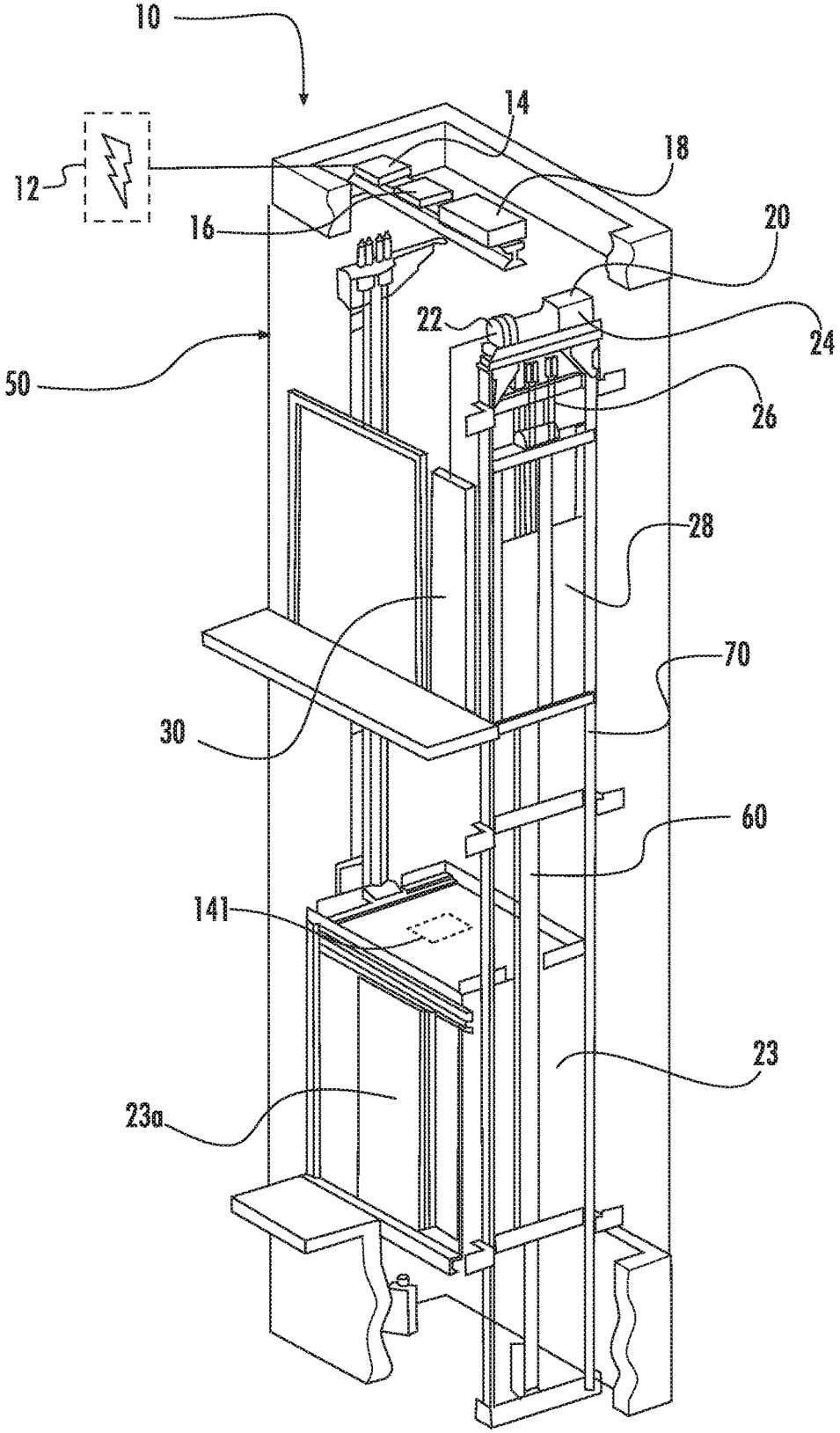
FIG. 1 illustrates a schematic view of an example elevator system, in accordance with an embodiment of the disclosure.
Figure 2:
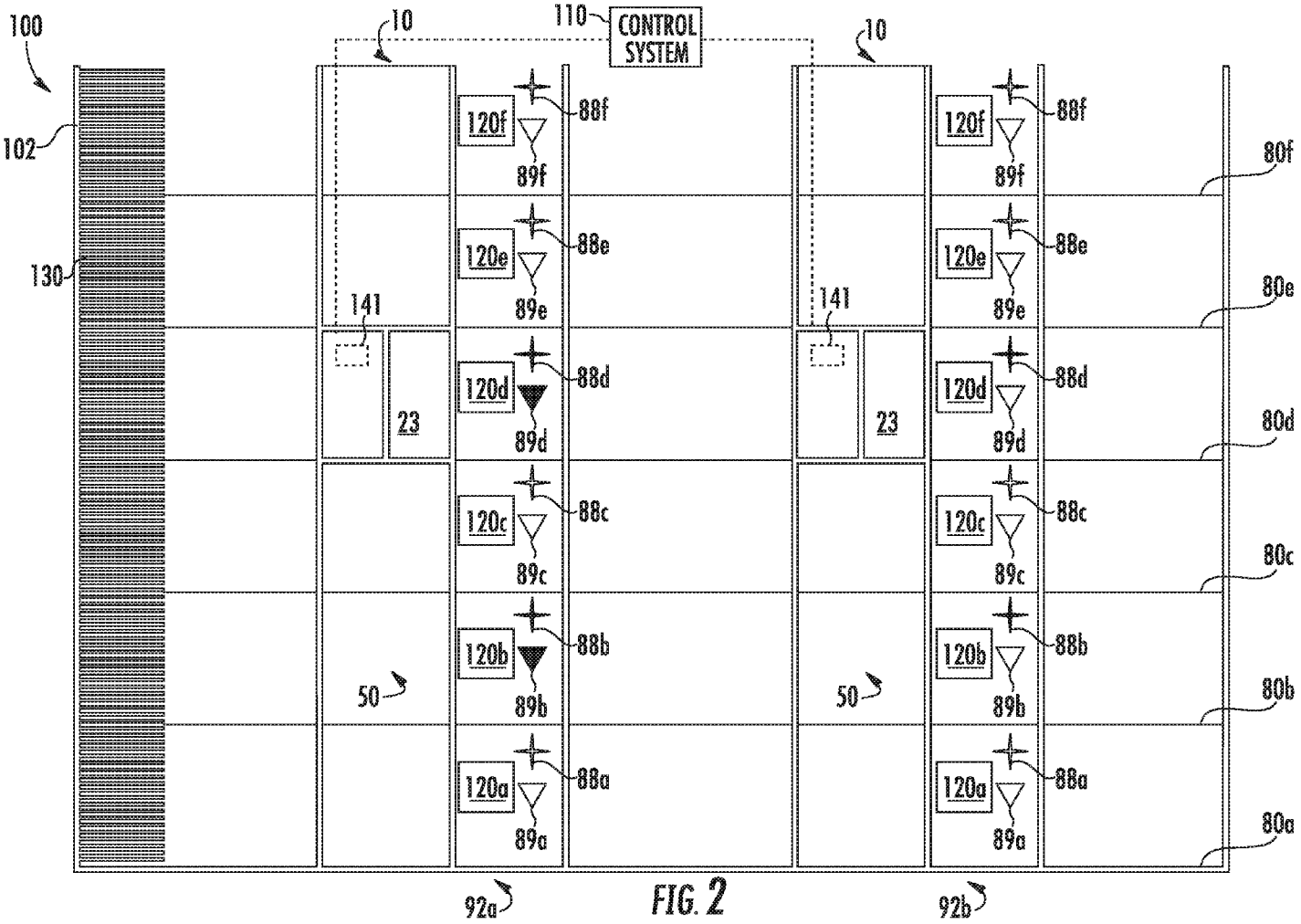
FIG. 2 illustrates a schematic view of an example building elevator system, in accordance with an embodiment of the disclosure.
Figure 3:
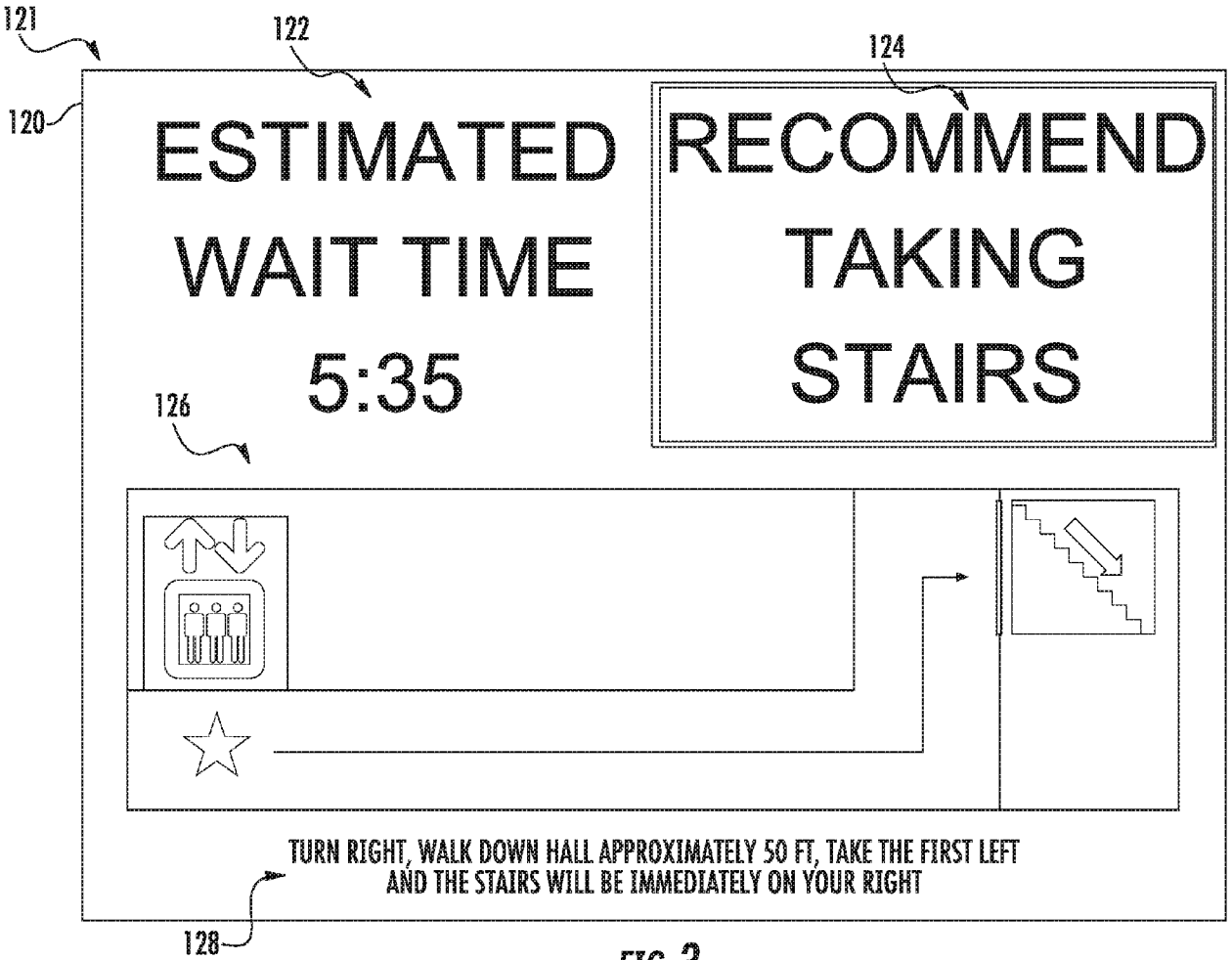
FIG. 3 illustrates a schematic view of an example dynamic display for use in the example building elevator system of FIG. 2, in accordance with an embodiment of the disclosure.

FIG. 1 shows a schematic view of an example elevator system 10, in accordance with an embodiment of the disclosure. FIG. 2 shows schematic view of an example building elevator system 100, in accordance with an embodiment of the disclosure. FIG. 3 illustrates a schematic view of an example dynamic display 120 for use in the example building elevator system of FIG. 2, in accordance with an embodiment of the disclosure. With reference to FIG. 1, the elevator system 10 includes an elevator car 23 configured to move vertically upward and downward within a hoistway 50 along a plurality of car guide rails 60. The elevator system 10 also includes a counterweight 28 operably connected to the elevator car 23 via a pulley system 26. The counterweight 28 is configured to move vertically upward and downward within the hoistway 50. The counterweight 28 moves in a direction generally opposite the movement of the elevator car 23, as is known in conventional elevator systems. Movement of the counterweight 28 is guided by counterweight guide rails 70 mounted within the hoistway 50. The elevator car 23 also has doors 23*a* to open and close, allowing passengers to enter and exit the elevator car 23.

The elevator system 10 also includes a power source 12. The power is provided from the power source 12 to a switch panel 14, which may include circuit breakers, meters, etc. From the switch panel 14, the power may be provided directly to the drive unit 20 through the controller 30 or to an internal power source charger 16, which converts AC power to direct current (DC) power to charge an internal power source 18 that requires charging. For instance, an internal power source 18 that requires charging may be a battery, capacitor, or any other type of power storage device known to one of ordinary skill in the art. Alternatively, the internal power source 18 may not require charging from the AC external power source 12 and may be a device such as, for example a gas powered generator, solar cells, hydroelectric generator, wind turbine generator or similar power generation device. The internal power source 18 may power various components of the elevator system 10 when an external power source is unavailable. The drive unit 20 drives a machine 22 to impart motion to the elevator car 23 via a traction sheave of the machine 22. The machine 22 also includes a brake 24 that can be activated to stop the machine 22 and elevator car 23. As will be appreciated by those of skill in the art, FIG. 1 depicts a machine room-less elevator system 10, however the embodiments disclosed herein may be incorporated with other elevator systems that are not machine room-less or that include any other known elevator configuration. In addition, elevator systems having more than one independently operating elevator car in each elevator shaft and/or ropeless elevator systems may also be used. In one embodiment, the elevator car may have two or more compartments.

The controller 30 is responsible for controlling the operation of the elevator system 10. The controller 30 is tied to a control system 110 (FIG. 2), which is responsible for controlling multiple elevator systems 10 and will be discussed below. The controller 30 may also determine a mode (motoring, regenerative, near balance) of the elevator car 23. The controller 30 may use the car direction and the weight distribution between the elevator car 23 and the counterweight 28 to determine the mode of the elevator car. The controller 30 may adjust the velocity of the elevator car 23 to reach a target floor. The controller 30 may include a processor and an associated memory. The processor may be, but is not limited to, a single-processor or multi-processor system of any of a wide array of possible architectures, including field programmable gate array (FPGA), central processing unit (CPU), application specific integrated circuits (ASIC), digital signal processor (DSP) or graphics processing unit (GPU) hardware arranged homogenously or heterogeneously. The memory may be but is not limited to a random access memory (RAM), read only memory (ROM), or other electronic, optical, magnetic or any other computer readable medium.

The elevator system 10 may also include a sensor system 141 configured to detect a number of occupants in a particular elevator car 23. The sensor system 141 is in operative communication with the controller 30. The sensor system 141 may use a variety of sensing mechanisms such as, for example, a visual detection device, a weight detection device, a laser detection device, a door reversal monitoring device, a thermal image detection device, and a depth detection device. The visual detection device may be a camera that utilizes visual recognition to identify and count individual passengers. The weight detection device may be a scale to sense the amount of weight in an elevator car 23 and then determine the number of passengers from the weight sensed. The laser detection device may detect how many passengers walk through a laser beam to determine the number of passengers in the elevator car 23. Similarly, a door reversal monitoring device also detects passengers entering the car so as not to close the elevator door on a passenger and thus may be used to determine the number of passengers in the elevator car 23. The thermal detection device may utilize thermal imaging to identify individual passengers and objects in the elevator car 23 and then determine the number of passengers. A depth detection device may determine the number of passengers by sensing that how much space is occupied in a car using sound waves.

As may be appreciated by one of skill in the art, in addition to the stated methods, additional methods may exist to sense the number of passengers and one or any combination of these methods may be used to determine the number of passengers in the elevator car.

FIG. 2 shows a building elevator system 100 incorporating multiple elevator systems 10 into elevator banks 92*a*, 92*b* in a building 102. Each individual elevator bank 92*a*, 92*b* may have one or more elevator systems 10. The building 102 includes multiple floors 80*a*-80*f*, each floor 80*a*-80*f* having an elevator call button 89*a*-89*f* and an evacuation alarm 88*a*-88*f*. The elevator call button 89*a*-89*f* sends an elevator call to the controller 30. The elevator call button 89*a*-89*f* may be a push button and/or a touch screen and may be activated manually or automatically. For example, the elevator call button 89*a*-89*f* may be activated by a building occupant pushing the elevator call button 89*a*-89*f*. The elevator call button 89*a*-89*f* may also be activated voice recognition or a passenger detection mechanism in the hallway, such as, for example a weight sensing device, a visual recognition device, and a laser detection device. The evacuation alarm 88*a*-88*f* may be activated or deactivated either manually or automatically through a fire alarm system. If the evacuation alarm 88*a*-88*f* is activated, the evacuation call is sent to the controller 30 indicating the respective floor 80*a*-80*f* where the evacuation alarm 88*a*-88*f* was activated. In the example of FIG. 2, an evacuation alarm 88*d* is activated first on floor 88*d* and then a second evacuation alarm 88*b* is later activated on floor 80*b*. The evacuation alarm 88*a*, 88*c*, 88*e*, 88*f* is not activated on floors 80*a*, 80*c*, 80*e*, and 80*f*. The first floor to activate an evacuation alarm 88*a*-88*f* may be known as the first evacuation floor. In the example of FIG. 2, the first evacuation floor is floor 80*d*. The second evacuation floor to activate an evacuation alarm may be known as the second evacuation floor and so on.

The first evacuation floor may be surrounded by padding floors, which are floors that are considered at increased risk due to their proximity to the evacuation floor and thus should also be evacuated. In the example of FIG. 2, the padding floors for the first evacuation floor are floors 80*b*, 80*c*, 80*e*, and 80*f*. The padding floors may include floors that are a selected number of floors away from the first evacuation floor. In one embodiment, the padding floors may include any number of floors on either side of an evacuation floor. For example, in one embodiment, the padding floors may include the floor immediately below the evacuation floor and the three floors immediately above the evacuation floor. In an example, in one embodiment, the padding floors may include the two floors above the first evacuation floor and the two floors below the first evacuation floor. The first evacuation floor and the padding floors make up an evacuation zone. In the example of FIG. 2, the evacuation zone is composed of floors 80*b*-80*f*.

In one embodiment, there may be more than one evacuation floor. For example, after the first evacuation floor activates an evacuation alarm, a second evacuation floor may also activate an evacuation alarm. In the example of FIG. 2, the second evacuation floor is floor 80*b*. In one embodiment, there may be any number of evacuation floors. Evacuation floors may be evacuated in the order that the evacuation call is received. Padding floors of the first evacuation floor may be evacuated before the second evacuation floor. In one embodiment, all evacuation floors may be evacuated first, followed by padding floors associated with each evacuation floor in the order in which the corresponding evacuation call was placed. Although in the embodiment of FIG. 2 the second evacuation floor is contiguous to the padding floors of the first evacuation floor, the second evacuation floor and any subsequent evacuation floors may be located anywhere within the building. The building also includes a discharge floor, which is a floor where occupants can evacuate the building 102. For example, in one embodiment the discharge floor may be a ground floor. In one embodiment, the discharge floor may be any floor that permits an occupant to evacuate the building. In the example of FIG. 2, the discharge floor is floor 80*a*. The building may also include a stairwell 130 as seen in FIG. 2.

The control system 110 is operably connected to the controller 30 of each elevator system 10. The control system 110 is configured to the control and coordinate operation of multiple elevator banks 92*a*, 92*b*. The control system 110 may be an electronic controller including a processor and an associated memory comprising computer-executable instructions that, when executed by the processor, cause the processor to perform various operations. The processor may be, but is not limited to, a single-processor or multi-processor system of any of a wide array of possible architectures, including field programmable gate array (FPGA), central processing unit (CPU), application specific integrated circuits (ASIC), digital signal processor (DSP) or graphics processing unit (GPU) hardware arranged homogenously or heterogeneously. The memory may be but is not limited to a random access memory (RAM), read only memory (ROM), or other electronic, optical, magnetic or any other computer readable medium.

In the illustrated embodiment, the building elevator system includes a first elevator bank 92*a* and a second elevator bank 92*b*. As mentioned above, each elevator bank 92*a*, 92*b* may include multiple elevator systems 10. As seen in FIG. 2, each elevator bank 92*a*, 92*b* includes a dynamic display 120*a*-120*f*. In the illustrated embodiment, the dynamic display 120*a*-120*f* is located proximate the elevator system 10 on each floor 80*a*-80*f*. In an embodiment, the dynamic display 120*a*-120*f* may also be located in the elevator car 23. In another embodiment, the dynamic display 120*a*-120*f* may be located in a fire command center. The dynamic display 120*a*-120*f* may be a monitor screen such as, for example a computer monitor and a television screen. In another embodiment, the dynamic display 120*a*-120*f* may be a mobile device such as, for example, a cellular phone, a smart watch, a tablet, a laptop computer or similar device known to one of skill in the art. In one example, in the event of an evacuation, a passenger may receive evacuation information 121 (FIG. 3) straight to their mobile device. In another example, evacuation information 121 (FIG. 3) may be sent directly to mobile devices carried by first responders, such as, for example firefighter, paramedics, and police.

Referring to FIG. 3, the dynamic display 120 displays evacuation information 121 comprising at least one of an estimated time of arrival 122 of the elevator car at the passenger's floor, an evacuee recommendation 124, a directional map 126, and directional instructions 128, as seen in FIG. 3. The estimated time of arrival 122 is the time that an evacuee may have to wait for the elevator car 23 to arrive at their floor. The estimated time of arrival 122 may also be called the "estimated wait time" as seen in FIG. 3. The estimated time of arrival 122 may be updated at a selected time interval, continuously, not at all, or if there has been a significant change to the estimated time of arrival 122. In an embodiment, the selected time interval may be 60 seconds. In one embodiment, the selected time interval may be greater than or less than 60 seconds. In another embodiment, a significant change may be an increase of 60 seconds in the estimated time of arrival 122. In one embodiment, the significant change may be greater than or less than 60 seconds. The control system 110 determines the estimated time of arrival 122 in response to at least one of a quantity of evacuation calls, an order of each evacuation call, a current location of the elevator car 23, a speed of the elevator car 23, a location of the dynamic display 120, a number of passengers on each floor 80*a*-80*f*, and a location of a fire. The control system 110 determines the evacuee recommendation 124 in response to at least one of the estimated time of arrival 122, evacuation scenario times, and a location of the dynamic display 120. The evacuation scenario times may be a database or algorithm detailing evacuation times for particular locations of the dynamic display 120. The evacuation scenario times may be pre-determined or continuously updated based on current conditions. The evacuation scenario times may be based on actual walking, estimated based on floor number (i.e., number of stairs to descend to exit floor) and distance from a location to stairs. The stored evacuation scenario may also factor in the number of passengers on each floor because more passengers may lead to slow evacuations times to due overcrowding in stairwells and hallways. In one example, the evacuee recommendation 124 may dictate to wait for the elevator car 23. In a second example, the evacuee recommendation 124 may dictate to take the stairs 130. In a third example, the evacuee recommendation 124 may dictate to move to another elevator bank. The evacuee recommendation 124 may be a static display, scrolling display and/or blinking display.

The control system 110 determines the directional map 126 in response to the evacuee recommendation 124 and stored building maps. Stored building maps may be maps of the overall building 102 and each individual floor 80*a*-80*f*. The directional map 126 may be a two-dimensional or three-dimensional map that displays the evacuee recommendation 124 that was determined. In one example, if the evacuee recommendation 124 dictates that the evacuee should take the stairs 130, then the directional map 126 will display the route to the closest stairwell. In a second example, if the evacuee recommendation 124 dictates that the evacuee should move from the first elevator bank 92*a* to the second elevator bank 92*b*, then the directional map 126 will display the shortest route from the first elevator bank 92*a* to the second elevator bank 92*b*. The directional map 126 may include directional instructions 128. The control system 110 determines the directional instructions 128 in response to the directional map 126. The directional instructions 128 may be the written and/or verbal instructions describing the directions displayed in the directional map 126. Further, the directional instructions 128 may be visual and/or audible. The evacuee recommendation 124 may be a static display, scrolling display and/or blinking display. When the dynamic display 120 is not being used to display evacuation information 121, the dynamic display 120 may be used to display other pertinent information, such as, for example information, directions, news, and advertisements. The dynamic display 120 may also include accessory light up displays to help convey information, such as, for example fixed light up signs, light up arrows, and floor lights. For instance, floor lights may guide evacuees to the nearest exit.

Figure 4:
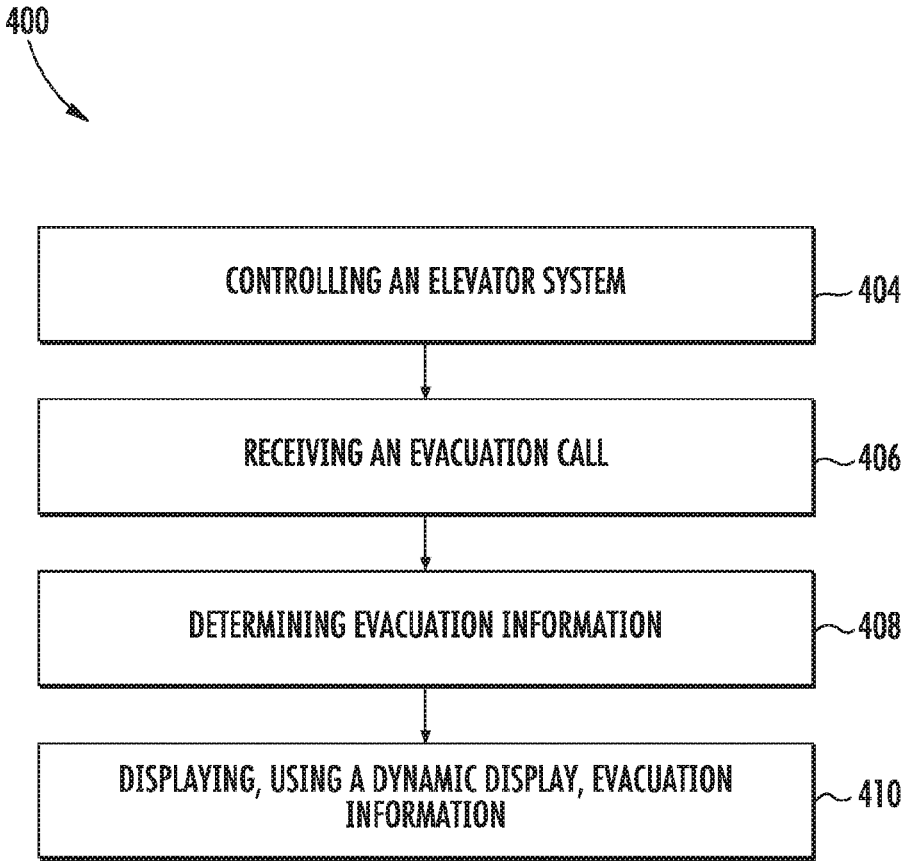
FIG. 4 is a flow chart of method of operating the example building elevator system of FIG. 2, in accordance with an embodiment of the disclosure.

Referring now to FIG. 4, while referencing components of FIGS. 1-3. FIG. 4 shows a flow chart of method 400 of operating the building elevator system 100 of FIG. 2, in accordance with an embodiment of the disclosure. At block 404, the control system 110 controls the elevator system 10. At block 406, the control system 110 receives an evacuation call. At block 408, the control system 110 determines evacuation information 121. At block 410, the dynamic display 120 displays the evacuation information 121. As mentioned above, the evacuation information 121 may include at least one of an estimated time of arrival 122 of the elevated car 23, the evacuee recommendation 124, the directional map 126, and the directional instructions 128. While the above description has described the flow process of FIG. 4 in a particular order, it should be appreciated that unless otherwise specifically required in the attached claims that the ordering of the steps may be varied.

As described above, embodiments can be in the form of processor-implemented processes and devices for practicing those processes, such as processor. Embodiments can also be in the form of computer program code containing instructions embodied in tangible media, such as network cloud storage, SD cards, flash drives, floppy diskettes, CD ROMs, hard drives, or any other computer-readable storage medium, wherein, when the computer program code is loaded into and executed by a computer, the computer becomes a device for practicing the embodiments. Embodiments can also be in the form of computer program code, for example, whether stored in a storage medium, loaded into and/or executed by a computer, or transmitted over some transmission medium, loaded into and/or executed by a computer, or transmitted over some transmission medium, such as over electrical wiring or cabling, through fiber optics, or via electromagnetic radiation, wherein, when the computer program code is loaded into an executed by a computer, the computer becomes an device for practicing the embodiments. When implemented on a general-purpose microprocessor, the computer program code segments configure the microprocessor to create specific logic circuits.

The terminology used herein is for the purpose of describing particular embodiments only and is not intended to be limiting. While the description has been presented for purposes of illustration and description, it is not intended to be exhaustive or limited to embodiments in the form disclosed. Many modifications, variations, alterations, substitutions or equivalent arrangement not hereto described will be apparent to those of ordinary skill in the art without departing from the scope of the disclosure. Additionally, while the various embodiments have been described, it is to be understood that aspects may include only some of the described embodiments. Accordingly, the disclosure is not to be seen as limited by the foregoing description, but is only limited by the scope of the appended claims.

What is claimed is:

1. A building elevator system comprising:

an elevator system having an elevator car;

a control system configured to control the building elevator system and determine evacuation information; and a dynamic display configured to display the evacuation information when an evacuation call is received by the control system;

wherein the evacuation information includes an estimated time of arrival of the elevated car, an evacuee recommendation, and at least one of a directional map and directional instructions, and wherein the evacuee recommendation is determined in response to the estimated time of arrival and at least one of evacuation scenario times and a location of the dynamic display.

2. The building elevator system of claim 1, wherein:

the estimated time of arrival of the elevator car is determined in response to at least one of a quantity of evacuation calls, an order of each evacuation call, a current location of the elevator car, a speed of the elevator car, a location of the dynamic display, a number of passengers on each floor, and a location of a fire.

3. The building elevator system of claim 1, wherein:

the directional map is determined in response to the evacuee recommendation and stored building maps.

4. The building elevator system of claim 1, wherein:

the directional instructions are determined in response to the directional map.

5. The building elevator system of claim 1, wherein:

the dynamic display is at least one of a mobile device and a monitor screen that is located on each floor of the building proximate the elevator system.

6. A method of operating a building elevator system, the method comprising:

controlling an elevator system, the elevator system including an elevator car;

receiving an evacuation call;

determining evacuation information; and displaying, using a dynamic display, evacuation information;

wherein the evacuation information includes an estimated time of arrival of the elevated car, an evacuee recommendation, and at least one of a directional map and directional instructions, wherein the evacuee recommendation is determined in response to the estimated time of arrival at least one of evacuation scenario times and a location of the dynamic display.

7. The method of claim 6, wherein:

the estimated time of arrival of the elevator car is determined in response to at least one of a quantity of evacuation calls, an order of each evacuation call, a current location of the elevator car, a speed of the elevator car, a location of the dynamic display, a number of passengers on each floor, and a location of a fire.

8. The method of claim 6, wherein:

the directional map is determined in response to the evacuee recommendation and stored building maps.

9. The method of claim 6, wherein:

the directional instructions are determined in response to the directional map.

10. The building elevator system of claim 6, wherein:

the dynamic display is at least one of a mobile device and a monitor screen that is located on each floor of the building proximate the elevator system.

11. A computer program product tangibly embodied on a computer readable medium, the computer program product including instructions that, when executed by a processor, cause the processor to perform operations comprising:

controlling an elevator system, the elevator system including an elevator car;

receiving an evacuation call;

determining evacuation information; and displaying, using a dynamic display, evacuation information;

wherein the evacuation information includes an estimated time of arrival of the elevated car, an evacuee recommendation, and at least one of a directional map and directional instructions, and wherein the evacuee recommendation is determined in response to the estimated time of arrival and at least one of evacuation scenario times and a location of the dynamic display.

12. The computer program of claim 11, wherein:

the estimated time of arrival of the elevator car is determined in response to at least one of a quantity of evacuation calls, an order of each evacuation call, a current location of the elevator car, a speed of the elevator car, a location of the dynamic display, a number of passengers on each floor, and a location of a fire.

13. The computer program of claim 11, wherein:

the directional map is determined in response to the evacuee recommendation and stored building maps.

14. The computer program of claim 11, wherein:

the directional instructions are determined in response to the directional map.

15. The computer program of claim 11, wherein:

the dynamic display is at least one of a mobile device and a monitor screen that is located on each floor of the building proximate the elevator system.

* * * * *